United States Patent [19]

Fleming

[11] Patent Number: 4,573,290

[45] Date of Patent: Mar. 4, 1986

[54] DRAIN SHIELD FOR EAVE GUTTERS

[76] Inventor: John H. Fleming, 53 Wildwood Ter., Glen Ridge, N.J. 07028

[21] Appl. No.: 643,682

[22] Filed: Aug. 23, 1984

[51] Int. Cl.[4] ..... E04D 13/06

[52] U.S. Cl. ..... 52/12; 248/48.1

[58] Field of Search ..... 52/11, 12; 248/48.1, 248/48.2; 210/473, 474

[56] References Cited

U.S. PATENT DOCUMENTS

| | | | |
|---|---|---|---|
| 2,537,243 | 1/1951 | Swartz | 52/12 |
| 2,734,467 | 2/1956 | Steele | 52/12 |
| 2,810,173 | 10/1957 | Bearden | 248/48.1 |
| 2,935,954 | 5/1960 | Matthews et al. | 52/12 X |
| 2,948,083 | 8/1960 | Steele | 52/12 |
| 3,080,682 | 3/1963 | Teutsch | 52/12 |
| 3,864,267 | 12/1975 | Nelems | 210/474 |
| 4,418,504 | 12/1983 | Lassiter | 52/12 |

FOREIGN PATENT DOCUMENTS

| | | | |
|---|---|---|---|
| 676446 | 12/1963 | Canada | 52/12 |

*Primary Examiner*—Stuart S. Levy

*Assistant Examiner*—Lynn M. Sohacki

*Attorney, Agent, or Firm*—Howard E. Thompson, Jr.

[57] ABSTRACT

An improved drain shield for eave gutters is provided in the form of screen sections adapted to be assembled in end-to-end relation along an eave gutter, such sections being of a width to overlie the gutter and first course of shingles and to extend under the second course of shingles for mounting purposes, such screen sections being formed of woven wire screening suitably having aligned square openings measuring approximately ¼-inch on the side, each screen section being deformed intermediate its front and rear edges and at a location to align with approximately the middle one third of the first course of shingles to dispose one line of said square openings perpendicular to the plane of the screen section, the portion of the screen section overlying the gutter thereby being raised approximately ¼-inch above the mounting portion, the perpendicularly disposed line of openings providing means for diverting water into the gutter while causing leaves and other debris to be carried over and discharged beyond the edge of the gutter.

8 Claims, 5 Drawing Figures

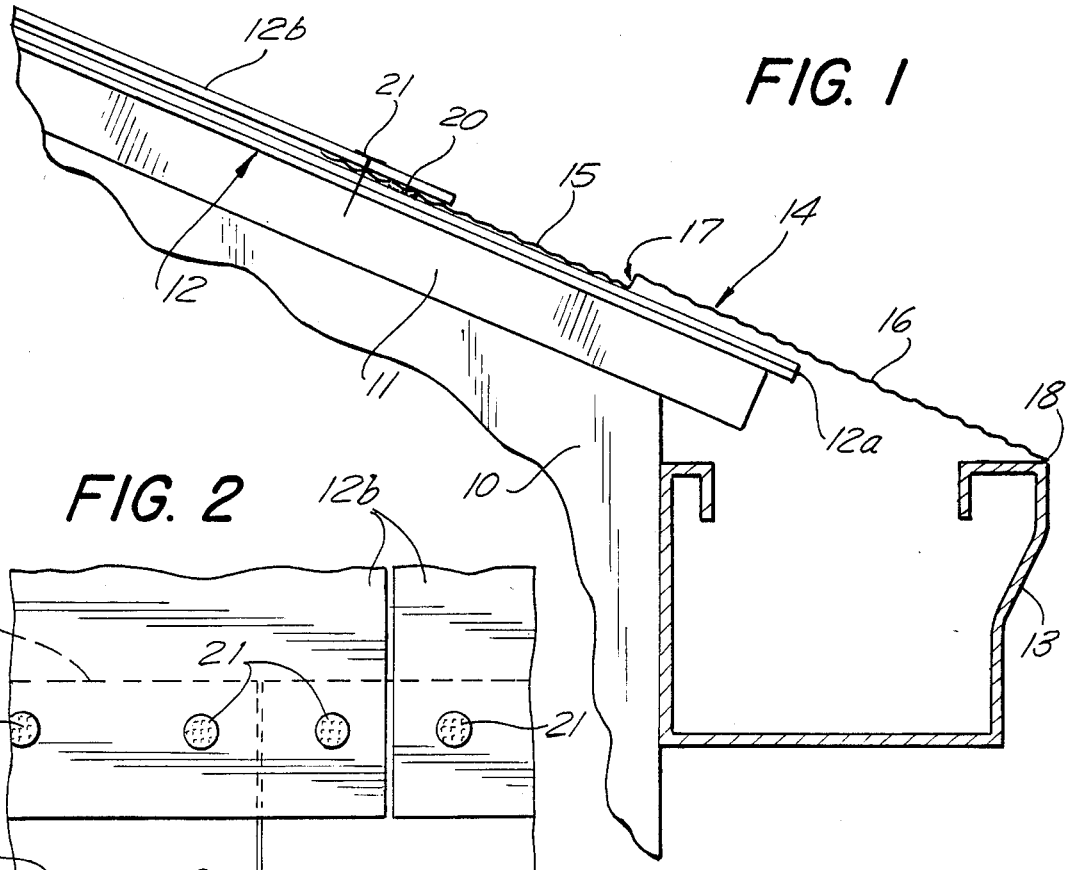
FIG. 1
FIG. 2
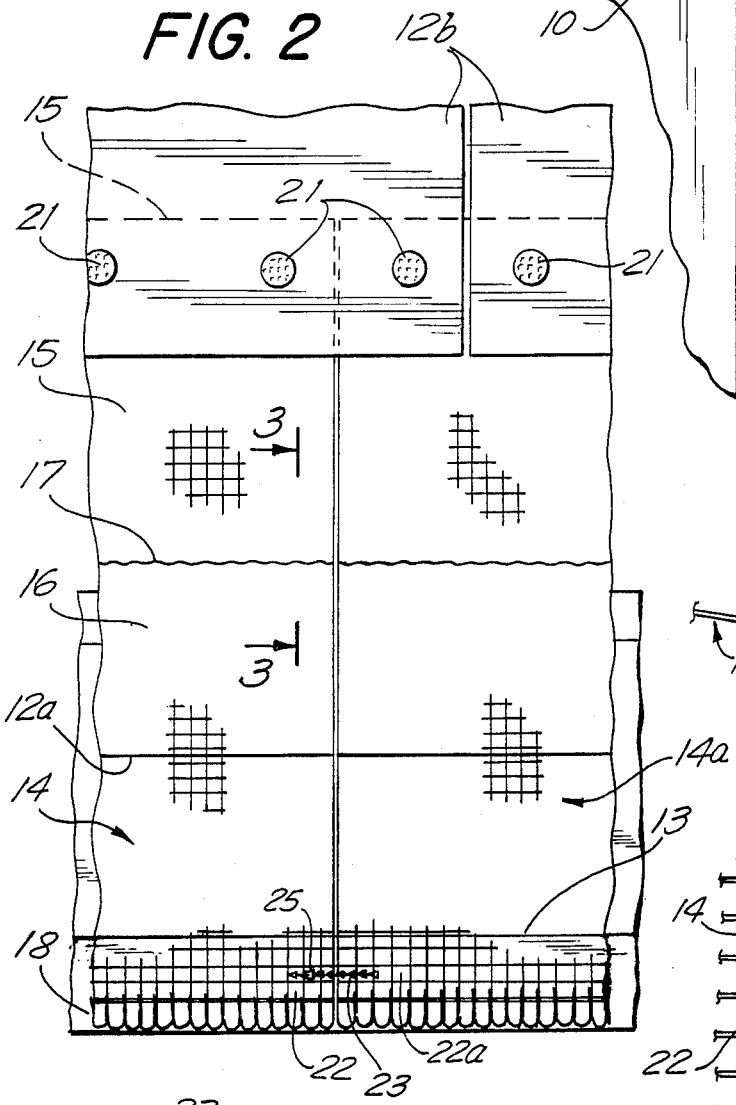
FIG. 3
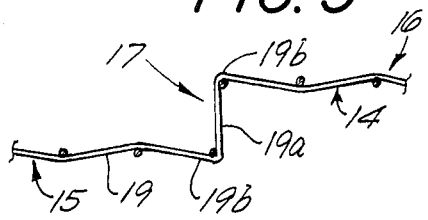
FIG. 4
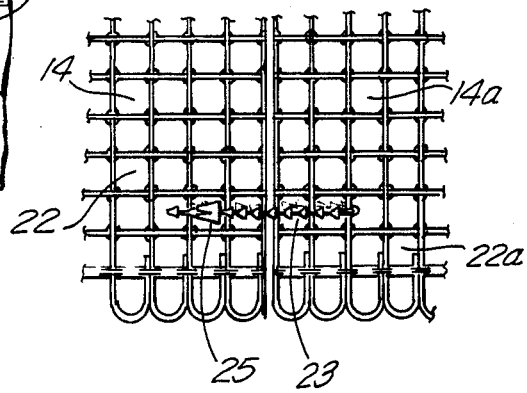
FIG. 5
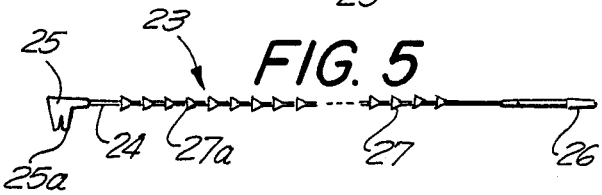

DRAIN SHIELD FOR EAVE GUTTERS

This invention relates to an improved drain shield for eave gutters in the form of screen sections adapted to be assembled in end-to-end relation along an eave gutter, such sections being of a width to overlie the gutter and first course of shingles and to extend under the second course of shingles for mounting purposes, such screen sections being formed of woven wire screening suitably having aligned square openings measuring approximately ¼-inch on the side, each screen section being deformed intermediate its front and rear edges and at a location to align with approximately the middle one third of the first course of shingles to dispose one line of said square openings perpendicular to the plane of the screen section, the portion of the screen section overlying the gutter thereby being raised approximately ¼-inch above the mounting portion, the perpendicularly disposed line of openings providing means for diverting water into the gutter while causing leaves and other debris to be carried over and discharged beyond the edge of the gutter.

The problem of keeping eave drain gutters free from debris and properly functioning has long plagued the owners of homes and other structures, particularly in areas where such structures are shaded by overhanging trees. The problem is somewhat seasonal, being greatest in the spring when blossoms are falling and in the autumn when leaves and other debris (such as acorns in the case of oak trees) are falling; but throughout the year, particularly during heavy wind and rain storms, twigs, leaves and other debris falling on roofs have a great tendency of collecting in gutters to impair their proper functioning. Thus in areas enjoying the shade and beauty of overhanging trees, the maintaining of eave gutters sufficiently debris-free to be properly functioning calls for frequent, time consuming, and sometime hazardous, gutter cleaning operations.

The nature of the problem above-described has inspired many in the past to devise means for minimizing the collection of leaves and other debris in eave gutters. Some approaches have involved screen-like members lying on top of the gutter, but these have the disadvantage of rapidly collecting enough debris to prevent water running down the roof from freely entering the gutter resulting in water, during heavy rains, being discharged over the gutter edge.

Others have provided open work or screen-like structures generally aligned with the pitch or angle of the roof and overlying the gutter. Typical examples of this approach are to be found in the following U.S. patents:

H. M. Steele U.S. Pat. No. 2,734,467 issued Feb. 14, 1956

B. Matthews et al. U. S. Pat. No. 2,935,954 issued May 10, 1960

H. M. Steele U.S. Pat. No. 2,948,083 issued Aug. 8, 1960

Will M. Lassiter U.S. Pat. No. 4,418,504 issued Dec. 6, 1983

Not only do these patents involve intricate structures for engagement with the gutter edge, but they disclose structures which, at least in periods of heavy rain, would cause most of the water to cascade over the gutter edge rather than being collected by the gutter as intended.

The improved drain shield for eave gutters in accordance with the present invention overcomes the problems inherent in the approaches in the above-mentioned patents and provides a simple, inexpensive structure universally adaptable for use with gutters of different size and configuration, and which by its unique structure assures that the bulk of the water running down a roof, even during a heavy rain, will be deposited in the gutter, essentially free of leaves and other debris.

Regarded in certain of its broader aspects the improved drain shield of the present invention comprises an essentially planar panel of screen-like structure providing essentially square openings approximately ¼-inch on the side, said panel having an end-to-end length somewhat greater than the front edge to rear edge width, said front edge being a finished edge, and the front to rear edge width being such as to overlie an eave gutter and the first course of shingles and to extend under the second course of shingles for anchorage by fastening means. The screen-like structure provides lines of essentially square openings extending parallel to said front and rear edges. Said panel is deformed at a position to fall within approximately the middle one third of said first course of shingles to dispose one line of said openings perpendicularly to the plane of said panel, thereby slightly elevating the plane of the panel from said deformed portion to the finished front edge. The perpendicularly disposed line of openings permits essentially debris-free water to flow into the gutter. A plurality of said panels are mounted in abutting end-to-end relation along the length of an eave gutter, and secured together by fastener means at the front corners of adjacent panels to provide continuity in the front edge of the assemblage, while permitting upward flexing of the front edge of the assemblage when access to the eave gutter may be needed.

The uniqueness of the improved structure resides in the perpendicularly disposed line of openings to be positioned within the middle one third of the first course of shingles. It might seem that simple screening without this offset would effect the desired separation of water and debris, but experimentation has demonstrated that when there is substantial flow of water down a roof, as in a heavy rain, the wire screening without the offset tends to conduct a significant portion of the water to and over the gutter edge thereby defeating the water collecting function of the gutter. With the perpendicularly disposed line of openings, however, it is found that even with a very heavy flow of water down the roof substantially all of the water will be deposited in the gutter essentially free of debris.

While the device may seem quite simple, the proper forming of the offset to provide the perpendicularly disposed line of openings requires intricate tooling to provide drain shield panels of sufficient uniformity to establish continuity as assembled in end-to-end relation.

While woven wire screening from which the panels are formed is normally handled in roll form, the above-described offset provides a longitudinal stiffening requiring that the panels be shipped and handled as flat panels; and for ease of handling and installation, such panels are suitably fabricated in standard 2 to 3-foot lengths. It will be noted in this connection that when equipping a particular eave gutter with drain shields of the present invention any reduction in size of the final panel in an installation can easily be made with conventional wire clippers.

Installation of the improved drain shields is extremely simple. The rear edge of a panel is merely slid under the second course of shingles a distance to align the front edge of the panel with the outer edge of the gutter, and the panel is then secured in position by staples or roofing nails passing through the second course of shingles. The next panel is similarly aligned, while bringing the ends into closely abutting relation; and after securing the second panel in position, the abutting front corners are joined together by suitable fastening means. For this purpose an ideal fastener is the beaded, plastic fasteners having a probe at one end and a lock element at the other which can be simply looped through the adjacent wire mesh, and after feeding the probe through the lock end and pulling the beaded section through the lock end until tight, the excess material is snipped off to leave a permanently locked fastener.

Novel features of the improved drain shield for eave gutters will be more fully understood from a consideration of the following description having reference to the accompanying drawing in which various parts of the device are identified by suitable reference characters in each of the views in which:

FIG. 1 is a sectional view through an eave and gutter showing the drain shield mounted in association therewith.

FIG. 2 is a fragmentary plan view of the assemblage shown in FIG. 1 taken at the juncture between two adjacent drain shield panels.

FIG. 3 is a fragmentary enlarged sectional view on the line 3—3 of FIG. 2.

FIG. 4 is an enlarged fragmentary view of the abutting corners and fastener means as shown in FIG. 2.

FIG. 5 is an illustration of a type fastener appropriate for joining abutting front corners as in FIG. 4.

As shown in FIG. 1 of the drawing a structure 10 having inclined roof 11 with conventional shingles 12 has an eaves trough or gutter 13 mounted below the roof edge to collect water running off the roof. As is customary the first course of shingles 12*a* comprises a double layer of shingles over which the second course 12*b* is laid at appropriate spacing from the lower edge of the first course 12*a*.

In this conventional assemblage a drain shield 14 has been shown having a planar portion 15 in direct engagement with the first course of shingles 12*a* and extending under the second course of shingles 12*b* which is joined to a second planar portion 16 by a perpendicularly disposed offset 17 with the forward edge 18 of the second planar portion aligning with the front edge of gutter 13.

As more clearly shown in FIGS. 2 to 4 of the drawing, the drain shield 14 is formed of woven wire screening preferably providing perpendicularly disposed rows of square openings 19 measuring approximately ¼-inch on the side, and being finished, as shown, along edge 18 of panel section 16. All overlapping and contacting portions of the wire screening should be bonded together as is customary in the production of ¼-inch glavanized wire screening to prevent lateral movement within the planar portions 15,16 of the drain shield 14.

The offset 17 is located approximately midway between the front and rear edges of the drain shield 14 to dispose the offset within approximately the middle one third of the first course of shingles 12*a*. As more clearly shown in FIG. 3, the offset 17 involves the orientation of one row of openings 19*a* perpendicular to the planar sections 15,16. This is accomplished by bending the wires forming the next adjacent rows of openings 19*b*, while avoiding distortion of the wire openings 19*a*, as clearly shown in FIG. 3 of the drawing. The offset 17 thus presents an open work structure permitting free movement of water threrethrough and under panel section 16 into the gutter while causing leaves and other debris to be carried by panel section 16 beyond the gutter edge.

The offset 17 provides a degree of stiffness in the drain shield 14 requiring that the drain shields be packaged and handled as flat panels with a number of such panels conveniently nesting together by interengagement of the offsets 17 thereof. For ease of handling and installation, the drain shields are fabricated and packaged in convenient 2-foot to 3-foot lengths.

Installation of the drain shields is easily accomplished by inserting a first drain shield at one end of the gutter under the second course of shingles 12*b* so as to align the front edge 18 with the edge of the gutter 13 and then placing a second drain shield 14*a* in end-to-end abutting relation as shown in FIG. 2. The properly positioned drain shields can be anchored in position by small quantities of roofing cement 20 placed under the second course of shingles 12*b* as shown in FIG. 1. Alternatively, or in addition to the cement bonding, roofing nails or other fasteners 21 can be employed.

The front edges 18,18*a* may be slightly flexed upwardly or downwardly as needed to be in contact with the edge of gutter 13, and the adjacent corners 22,22*a* are joined in aligned relation by fastener means 23.

As more clearly shown in FIGS. 4 and 5 the fastener means 23 may comprise the convenient and commercially available plastic tie as shown in FIG. 5. This type of plastic tie comprises an elongated strand 24 having a lock socket 25 at one end, a probe 26 at the other end for easy insertion into the lock socket, and a plurality of conical enlargements 27 closely spaced along the strand 24 with the small dimensions thereof pointed in the direction of the probe 26. As the flat base 27*a* of a conical projection is engaged by the flex-ends 25*a* of the socket 25, a positive interlock is obtained. Thus by lacing the fastener 23 through openings in the adjacent corners 22*a*, passing the probe 26 through lock socket 25, and pulling the strand 26 as far as possible through the lock socket 25, a tight clamping together of the panel corners 22,22*a* is achieved. By merely snipping off the projecting portion of the fastener 23, a neat and almost undetectable joining of the panel corners 22,22*a* is achieved. It will be understood, however, that the particular type fastener 23 above-described forms no part of the present invention. While this particular type fastener is considered to be uniquely appropriate, it will be apparent that many other type fasteners could be employed in joining the panel corners 22,22*a*.

With conventional laying of roof shingles generally providing a 5 to 6-inch exposure for each course of shingles, and with eave gutters generally mounted to have the forward edge extending about 4 to 5-inches beyond the roof edge, it will be apparent that drain shields having a front to rear dimension of 12-inches will be appropriate for use with most eave gutters. It is realized, however, that not all roof and gutter structures will fall within the dimensional ranges above-noted. Thus it is contemplated that drain shields according to the present invention should be made available in two or three standard sizes, differing in the front edge to rear edge dimension and the location of the offset 17, noting in this connection that the offset 17 should preferably be located within approximately the middle one third of the first course of shingles when installed.

While the drain shields have been described above as fabricated from woven wire mesh material, suitably ¼-inch galvanized wire mesh, it will be understood that all structural features could be incorporated in drain shields formed from molded, plastic material. Polyethylene, polypropylene and numerous other currently available plastics having resistance to attack by the elements could be used in thus fastening the drain shields from plastic material.

If the drain shields are fashioned from plastic material, the offset 17 could be fashioned in the initial forming or molding operation to directly produce finished drain shields 14. Alternatively, if the particular plastic being used is of the thermoplastic type, the basic screen-like structure could be continuously formed in the flat orientation with the offset 17 being produced by means of suitable forming tools and local heating to temporarily soften the thermoplastic material.

Whether formed of wire mesh or plastic material as above-described, the drain shields could preferably be packaged as 2 to 3-foot sections to be installed in end-to-end abutting relation as above-described.

Various changes and modifications in the drain shields for eave gutters as herein disclosed may occur to those skilled in the art; and to the extent that such changes and modifications are embraced by the appended claims, it is to be understood that they constitute part of the present invention.

I claim:

1. A drain shield for eave gutters in the form of screen sections adapted to be assembled in end-to-end relation along an eave gutter, each such section being of a front to rear dimension to overlie the gutter and first course of shingles and to extend under the second course of shingles for mounting purposes, such screen section being of open screen-like structure suitably having aligned square openings measuring approximately ¼-inch on the side, each screen section being upwardly deformed intermediate its front and rear edges and at a location to align with approximately the middle one third of the first course of shingles to divide said section into a mounting portion and a gutter overlying portion, and to dispose one line of said square openings perpendicular to the plane of the screen section, the portion of the screen section overlying the gutter thereby being raised approximately ¼-inch above the mounting portion, and the perpendicularly disposed line of openings providing means for diverting water into the gutter while causing leaves and other debris to be carried over and discharged beyond the edge of the gutter.

2. A drain shield for eave gutters as defined in claim 1, wherein each section is about 2 to 3-feet in length with at least one finished edge adapted to overlie the gutter edge, and abutting sections, at corners thereof overlying the gutter edge, being maintained in coplanar orientation by fastener means passing through said openings.

3. A drain shield for eave gutters as defined in claim 1, wherein said sections are fashioned from woven wire screening with coating means bonding together overlapping wire strands.

4. A drain shield for eave gutters as defined in claim 3, wherein the deformation to perpendicularly dispose one line of openings is achieved by bending said screening at locations falling within the next adjacent lines of openings.

5. A drain shield for eave gutters as defined in claim 1, wherein said sections are formed from molded plastic material.

6. A drain shield for eave gutters as defined in claim 5, wherein the deformed line of openings is produced in the molding operation.

7. A drain shield for eave gutters as defined in claim 5, wherein the screened material is continuously molded from thermo plastic material and, after cutting into section lengths, the deformed line of openings is fashioned by a subsequent, heat assisted, reforming operation.

8. A drain shield for eave gutters as defined in claim 7, wherein the heat assisted reforming operation is accomplished in the lines of openings next adjacent said first-named line of openings.

* * * * *